US006070426A

United States Patent [19]

Sakashita et al.

[11] Patent Number: 6,070,426

[45] Date of Patent: Jun. 6, 2000

[54] EVAPORATIVE CONDENSATION TYPE AMMONIA REFRIGERATION UNIT

[75] Inventors: Shigeru Sakashita; Yuji Takasawa, both of Tokyo, Japan

[73] Assignee: Mayekawa Mfg. Co., Ltd., Tokyo, Japan

[21] Appl. No.: 09/254,546

[22] PCT Filed: Jul. 9, 1998

[86] PCT No.: PCT/JP98/03080

§ 371 Date: May 11, 1999

§ 102(e) Date: May 11, 1999

[87] PCT Pub. No.: WO99/02930

PCT Pub. Date: Jan. 21, 1999

[30] Foreign Application Priority Data

Jul. 10, 1997 [JP] Japan ..... 9-200769

[51] Int. Cl.[7] ..... F28D 5/00

[52] U.S. Cl. ..... 62/305; 62/114; 62/428

[58] Field of Search ..... 62/305, 114, 428

[56] References Cited

FOREIGN PATENT DOCUMENTS 411030460 2/1999 Japan .
411030463 2/1999 Japan .

*Primary Examiner*—Henry Bennett
*Assistant Examiner*—Chen-Wen Jiang
*Attorney, Agent, or Firm*—Evenson, McKeown, Edwards & Lenahan, P.L.L.C.

[57] ABSTRACT

An evaporative-cooling condensation type ammonia refrigeration unit with leaked ammonia gas removing means is provided. Recovery of a leaked ammonia gas is conducted taking advantage of a high solubility of ammonia in water, wherein the leaked ammonia gas is dissolved in a cooling water used for an evaporative condenser. The construction of the unit is characterized by including an ammonia absorptive structure in a gas/liquid countercurrent mode provided in a space on the lower side of the evaporative condenser accommodated in an upper chamber.

5 Claims, 6 Drawing Sheets

Enlarged view of E area

EVAPORATIVE CONDENSATION TYPE AMMONIA REFRIGERATION UNIT

BACKGROUND OF THE INVENTION

1. Field of the Invention

The present invention relates to an ammonia refrigeration unit with a fully packaged construction including an evaporative condenser, a compressor and an ammonia piping system, and particularly, to an evaporative-cooling condensation type ammonia refrigeration unit with leaked ammonia gas removing means.

2. Description of the Prior Art

A condenser-integrated refrigerator, in which a compressor and a condenser are combined in an integrated manner, and which is installable outdoors, has widely been employed, since i) a machine room is not necessary for installation, ii) only a two-way piping is required between a refrigeration unit and a load side, iii) not only can an installment space be saved but field piping work can also be lessened, v) a trial run can be conducted prior to shipment and less work is thereby required in the on-site start-up and the like.

An example of the refrigerator in which a compressor and a condenser is combined in an integrated manner is disclosed in the publication of Examined Japanese Utility Model Application No. Sho 56-5025. The invention, as seen in FIG. 6, comprises: an evaporative condenser 50 including a condenser 52 in which a heat transfer coil is its major constituent, water spray nozzles 58 for spraying cooling water over the condenser 52, a cooling water tank 53, a cooling wafer feed pipeline 59 and a suction blower 63; a compressor 57; a refrigerant pipeline 60; a cold water source 54; a water supplement pipeline 61 and the like, wherein such constituents are assembled in an integrated construction as a unit and accommodated in the same casing 51.

With such a construction of the integrated unit, external cooling loads 68, 68, 68 and an external water supply system 65 are connected with the unit by a pipeline 67 through pipeline connection terminals 64, 64 provided on a wall portion of the casing 51, whereby the field piping work is lessened to an extent as low as possible.

In the case where ammonia is employed as refrigerant, there are risks leading to serious problems in terms of toxicity and combustibility of the material since, according to a report from a research institute, a human being is badly affected in the atmosphere with an ammonia concentration in the range of from 0.5 to 1%: a life is lost or serious disturbance is caused in the body on a 30 min period exposure and explosion limits are established to be from 16 to 25% by volume content, which shows that leakage is easy to cause explosion or human related accidents. In order to avoid a chance of explosion induced accident or restrict it to a minor level, there has been a trend prevailing in very recent years that refrigerators using ammonia as refrigerant are distributed among locations spaced from one another and that ammonia piping is confined within each refrigeration unit which has been distributed.

Even in a refrigeration unit whose safety has seemingly be secured by locating it from another unit in a spaced manner, however, a safety measure for a human being in terms of toxicity and combustibility in the case of leakage of ammonia has not yet been established.

SUMMARY OF THE INVENTION

The present invention has been made in light of the above described problem and it is an object of the present invention to provide an evaporative-cooling condensation type ammonia refrigeration unit in which leaked ammonia gas is recovered using a characteristic that the gas shows a high solubility in water due to its polar nature, cooling water used for an evaporative condenser is also employed for dissolving the gas therein to form a solution and in addition a condensing temperature is lowered through adoption of the evaporative condenser, so that cost of performance of the refrigeration unit is improved.

The evaporative condenser is a technical hybrid between a water-cooled condenser and an air-cooled condenser and has a combined function of both condensers. In the evaporative condenser, cooling water is sprayed over the surface of a heat transfer coil through which refrigerant flows and air flow is sent onto the wet surface of heat transfer coil to induce the water staying on the surface to evaporate. Latent heat of evaporation required in the evaporation of the water is then used to cool and condense ammonia as refrigerant. The sprayed cooling water after the evaporation falls by its gravity into a tank under the heat transfer coil and then sends up to a water spray head by a circulating pump to effect circulation between the tank and the water spray header.

The air draft around the heat transfer coil is provided by a suction blower which is disposed at an upper position and guides air to flow upward by suction or by a forced draft blower which is disposed at a lower part of the side and forces air to flow upward by forced draft.

It is, accordingly, another object of the present invention to provide evaporative-cooling condensation type ammonia refrigeration units, which are safe and can remove leaked ammonia gas, and which respectively correspond to the units of a suction type and a forced draft type.

In order to achieve the objects, an evaporative-cooling condensation type refrigeration unit of the present invention is a refrigeration unit with a fully packaged construction locating from another unit in a spaced manner which is provided with an upper chamber for accommodating an evaporative condenser to condense ammonia gas and a lower chamber for accommodating a compressor to compress ammonia gas and a ammonia piping system, comprises: contact dissolution means in which leaked ammonia gas from the ammonia piping system is guided into the upper chamber from the lower chamber and can be dissolved through contact into cooling water spray for the evaporative condenser; and aqueous ammonia recovery means.

The contact dissolution means of the present invention comprises: a gas guide constructed from upward-open troughs each having a semicylindrical shape for recovering sprayed cooling water and downward-open troughs each having a semicylindrical shape for not only guiding the sprayed cooling water into the recovery troughs by intercepting a direct downflow of the sprayed cooling water into the gaps between the upward open troughs but forming detour passages for the upflow of the leaked ammonia gas, and thereby performing gas-liquid contact dissolution, while gaps for permitting an upflow of leaked ammonia gas therethrough are provided in the space under the evaporative condenser in the upper chamber. Besides, the upper chamber, which includes the gas guide and the evaporative condenser, is further provided with a suction blower equipped therein so that a negative pressure is produced therein and thereby a general passage for a gas flow from the lower chamber, to the upper chamber and further into the outside of the package is formed, wherein the ammonia absorption/recovery means is inserted in the general passage as described above.

Another contact dissolution means of the present invention may be constructed so that the means is provided with a group of three or more lateral arrays of parallel inclined troughs for cooling water spray recovery of vertically different levels being vertically arranged in a zig-zag manner while gaps for permitting an upflow of leaked ammonia gas therethrough are provided in the space under the evaporative condenser in the upper chamber, wherein the troughs in each of the second level and the following levels downward are respectively inserted in cellular spaces of a honeycomb structure each having a hexagonal prism or a near hexagonal prism shape, and comprises: countercurrent gas/liquid mixing sections each formed between an upflow of leaked ammonia gas formed along both sides of a trough inserted in a cellular space and a downflow of sprayed cooling water from an upper portion; a gas guide for permitting a gas flow provided in order to guide an upflow of the leaked ammonia gas, while preventing a downflow of the sprayed cooling water into a gap between the adjacent troughs in the lowest level array from occurring; and a negative pressure of a suction blower which produces the upflow of the leaked ammonia gas.

In addition, further contact dissolution means of the present invention may be constructed so that leaked ammonia gas can be dissolved through contact into cooled water spray with the help of a flow guide passage for leaked ammonia gas provided on the suction side of a forced draft blower, in the upper chamber which is communicated from the perfectly gastight lower chamber and a negative pressure on the suction side.

Aqueous ammonia recovery means of the present invention comprises: a recovery and circulation cooling water tank, which is communicated to a lower portion of the upper chamber, and which is disposed on the side of the lower chamber; an ammonia detector; and a cooling water circulation pump. Therefore, according to an evaporative-cooling condensation type refrigeration unit of the present invention, the unit has a packaged construction in an integral manner which comprises the two chambers, upper and lower, wherein, for example, in the case of a suction type, the upper chamber is provided with a suction flower at the top and an evaporative condenser comprising cooling water spray nozzles disposed under the suction blower for production of cooling water spray and a heat transfer coil which is used for condensing ammonia refrigerant further located under the cooling water spray nozzles, while the lower chamber is provided with a compressor for compressing ammonia which is refrigerant, and devices and parts including an ammonia piping system, so that a fully-packaged, distributed installation type refrigeration unit is constructed, wherein the unit further comprises: contact dissolution means whereby leaked ammonia gas from the ammonia piping system is guided into the upper chamber from the lower chamber and can be dissolved into cooling water spray of the evaporative condenser by contact; and aqueous ammonia recovery means, so that a safety measure against leaked ammonia gas is established.

The contact dissolution means comprises constitutions respectively corresponding to a forced draft type evaporative condenser and a suction type evaporative condenser. A contact dissolution means of the present invention corresponding to the forced draft type evaporative condenser is constituted from a flow guide passage for leaked ammonia gas provided near a suction port of a forced draft blower in the upper chamber which is communicated from the perfectly gastight lower chamber and a negative pressure on the suction side.

That is, the leaked ammonia gas produced in the lower chamber is guided to the suction side of the forced draft blower in the upper chamber under influence of a negative pressure on the suction side. Then, the guided ammonia gas is blown into cooling water spray to form aqueous ammonia through contact dissolution.

Thus produced aqueous ammonia and the sprayed cooling water flow into a cooling tank in a recess section which is formed in the floor portion of the upper chamber and stored in the tank.

A contact dissolution means of the present invention corresponding to a suction type evaporative condenser is constituted from: slit like gaps for passage of ammonia gas provided in a boundary wall between the upper and power chambers; a leaked ammonia gas guide constructed from gaps in a group of plural upward-open troughs each having a semicylindrical shape disposed in a lateral arrangement of parallel inclined arrays and gaps in a group of downward-open troughs each having a semicylindrical shape provided so that each trough in the group of downward-open troughs covers a gap in the group of upward-open troughs; and a suction pressure of a suction blower.

That is, leaked ammonia gas produced in the lower chamber rises through slit-like gaps provided in the boundary wall between the lower chamber and the upper chamber by the suction pressure and further rises threading its way through the leaked ammonia gas guide constructed from the gaps in the group of upward-open troughs and the gaps in the group of downward open troughs disposed laterally in a space above of the upward open troughs again by the section pressure, during which the leaked ammonia gas is dissolved into sprayed cooling water through contact to form aqueous ammonia.

Then, how thus formed aqueous ammonia and the sprayed cooling water flow will be described.

Downflow passage toward the gaps formed between the upward open troughs is intercepted by the downward open troughs, all the cooling water and the aqueous ammonia flow into the upward open troughs and further flow down into a cooling water tank provided in a recess at a lower position by a proper inclination of the laterally disposed troughs and is stored in the tank.

A contact dissolution means of the present invention corresponding to the suction type evaporative condenser may be constructed as follows.

That is, three or more lateral arrays of parallel inclined troughs at vertically different adjacent levels are vertically arranged in a zig-zag manner and while cellular spaces of a honeycomb structure are formed in the second highest array, each of which space has a hexagonal prism or a near hexagonal prism shape with an upward opening in cooperation with troughs in the first trough array on the both sides of a cellular space in the second highest trough array, cellular spaces of a honeycomb structure are also formed in each of the third highest and the following arrays downward respectively, each of which space has a hexagonal prism or a near hexagonal prism shape with an almost closed upper portion in cooperation with troughs in the trough array direct above the third highest or one of the following trough arrays on the both sides of a cellular space in the third highest or one of the following trough arrays. An upflow of the leaked ammonia gas formed along both sides of a trough accommodated in an upward open cellular space or a closed cellular space of the honeycomb structure and a downflow of the sprayed cooling water from an upper portion form a cross, counter current gas/liquid mixing section.

With the above described construction, the leaked ammonia gas rises threading its winding way through troughs which are vertically arranged in a zig-zag manner by way of the gaps provided in the ceiling of the lower chamber from the lower chamber by the negative pressure effect caused by the suction blower, during which the leaked ammonia gas is repeatedly subjected to gas/liquid contact of a cross, counter current mode with the sprayed cooling water from an upper portion in gas/liquid mixing sections in the cellular spaces in a multi-layer honeycomb structure and as a result the leaked ammonia gas is sufficiently absorbed into the cooling water, whereby the cooling water with absorbed ammonia therein flows in inclined troughs and reaches the cooling water tank provided in a recess at the lower position and is stored therein.

A gas guide for permitting a gas flow are provided in order to guide an upflow of the leaked ammonia gas, while preventing a downflow of the sprayed cooling water into a gap between adjacent troughs at the lowest level from occurring and thereby a passage of the sprayed cooling water toward the lower chamber is intercepted.

It is preferable that a trough has a shape of a hull and the shape is suitable for inserting the trough in one of cellular spaces in a honeycomb structure.

Recovery means of the present invention as described above is constructed from a cooling water tank which is provided on the side of the lower chamber or on the side of the upper chamber, a ammonia detector and a cooling water circulating pump.

BRIEF DESCRIPTION OF THE DRAWINGS

FIG. 4(A) is a longitudinal sectional view showing an arrangement, FIG. 4(B) is a side view taken in the direction of a double-point arrow IVB—IVB of FIG. 4(A) and ea middle area thereof shows an arrangement of troughs in a zig-zag manner while eliminating connecting portions and FIG. 4(C) is an enlarged view of a D area of FIG. 4(B).

FIG. 5(A) is a longitudinal sectional view showing an arrangement, FIG. 5(B) is a side view taken in the direction of a double-point arrow VB—VB of FIG. 5(A) and a middle area thereof shows an arrangement of troughs in a zig-zag manner while eliminating connecting portions and FIG. 5(C) is an enlarged view of an E area of FIG. 5(B).

Numeral marks of major constituents in the figures will be described: 10 indicates a compressor, 11 an oil separator, 12 a precooler, 13, a heat transfer coil, 15 cooling water spray nozzles, 17, 17*a*, 17*b* a cooling water tank, 18, evaporative condenser, 19, a suction blower, 21 a forced draft blower, 22 a blow-off port, 22*a*, 22*b* an upper chamber, 23*a*, 23*b* a lower chamber, 25 a group of upward open troughs, 26 a group of downward open troughs, 27: slit-like gaps, 30 flow guide passage, 31 outside air intake slits, 35, 36, 38, 40, 41, 42, 43 a hull type trough and 38, 42*a* a guide plate.

PREFERRED EMBODIMENTS TO EXECUTE THE INVENTION

Below, the present invention will be detailed using embodiments shown in the figures. It is to be noted, however, that sizes, materials, shapes of constituents and positional relations the constituents in arrangement which are described in the embodiments are not intended to restrict the present invention to the description unless otherwise specified, but rather shown for exemplifying purposes only.

Figure 1:
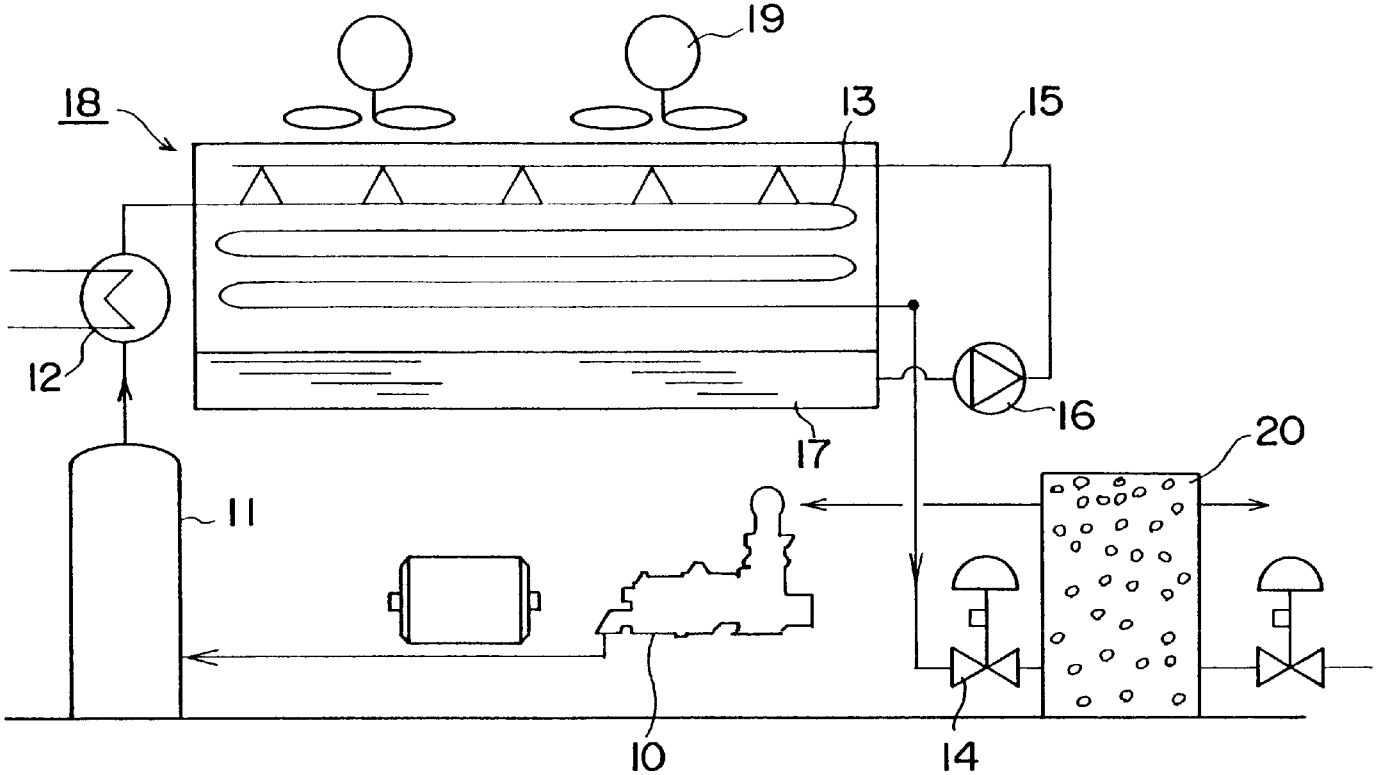
FIG. 1 is a representation schematically showing an example of a working state of circulation of refrigerant and an evaporative condenser when an evaporative-cooling condensation type refrigeration unit (a suction type) is used for production of dynamic ice.
Figure 2:
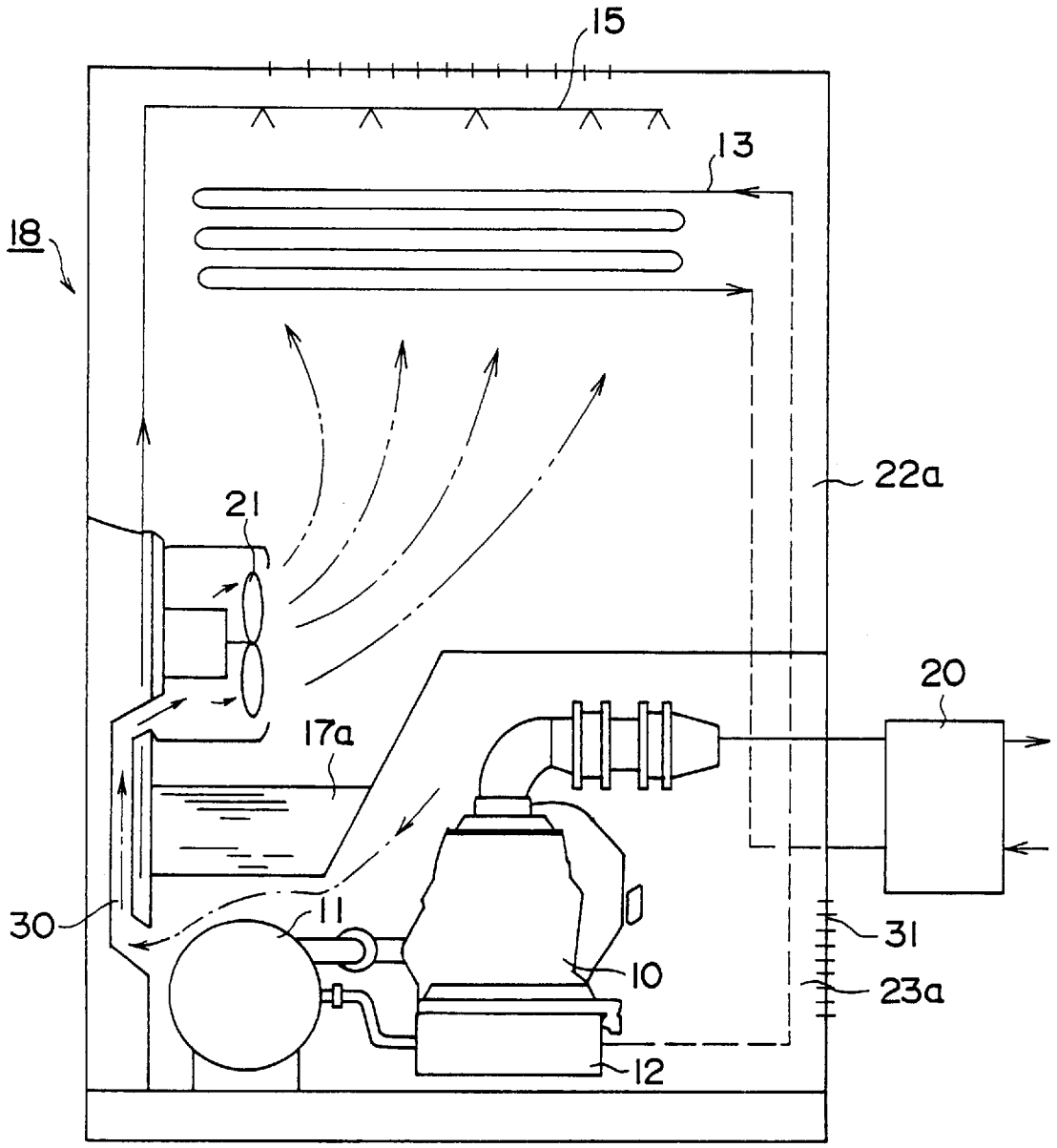
FIG. 2 is a longitudinal sectional view schematically showing a construction in the case of a forced draft, evaporative-cooling condensation type ammonia refrigeration unit of the present invention.
Figure 3A:
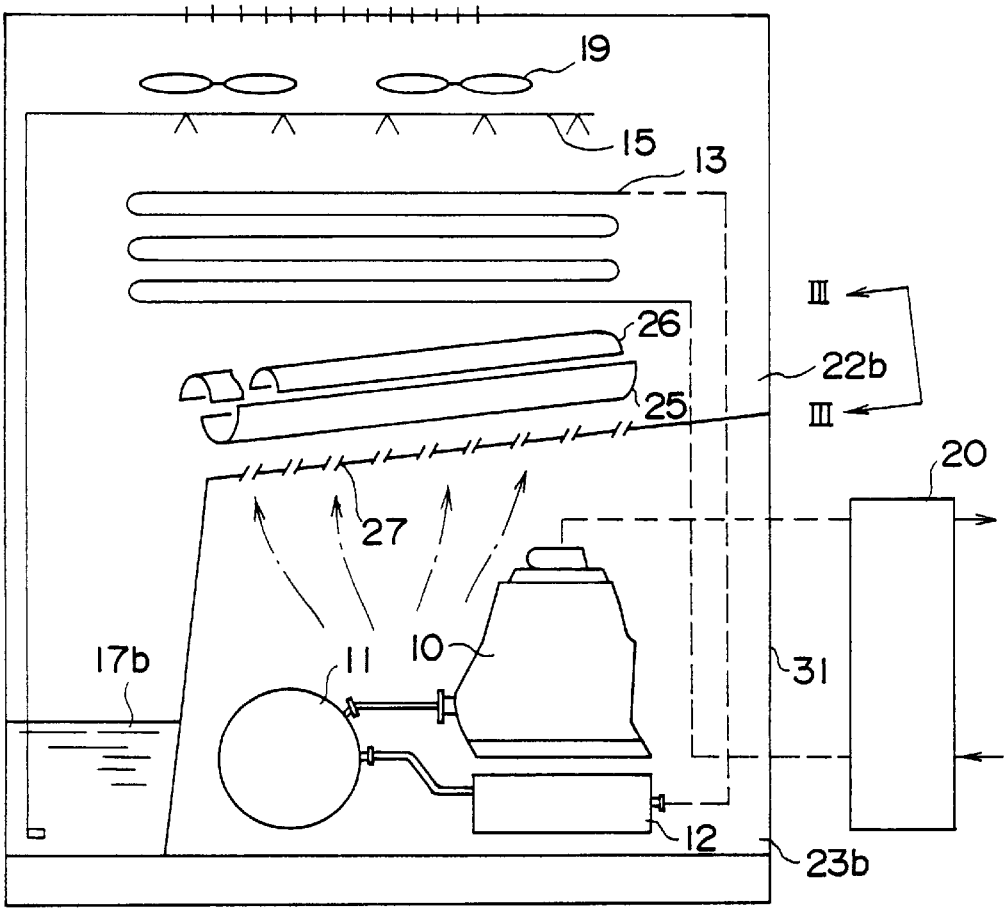
FIGS. 3(A) is a longitudinal sectional view schematically showing a construction in the casei of a suction, evaporative-cooling condensation type ammonia refrigeration unit of the present invention

FIG. 1 is a representation schematically showing an example of a working state of circulation of refrigerant and an evaporative condenser when an evaporative-cooling condensation type refrigeration unit (a suction type) is used for production of dynamic ice. FIG. 2 is a longitudinal sectional view schematically showing a construction in the case of a forced draft, evaporative-cooling condensation type ammonia refrigeration unit of the present invention. FIGS. 3(A) is a longitudinal sectional view schematically showing a construction in the case of a suction, evaporative-cooling condensation type ammonia refrigeration unit of the present invention and FIGS. 3(B) is a side view taken in the direction of a double-point arrow III—III.

Figure 3B:
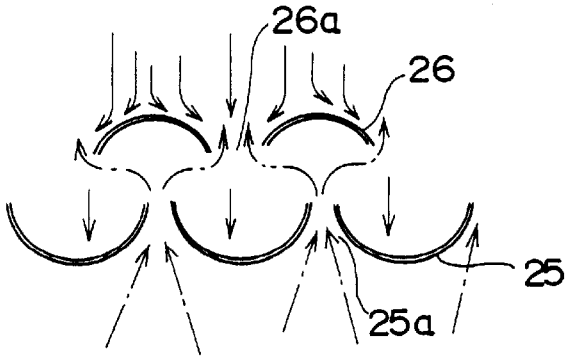
FIGS. 3(B) is a side view taken in the direction of a double-point arrow III—III.

FIGS. 4(A) to 4(C) and FIGS. 5(A) to 5(C) respectively are longitudinal sectional views, side views taken in the directions of double-point arrows IVB—IVB and VB—VB of the sectional views and enlarged views of D and E areas of the side views showing first and second embodiment different from the embodiment of FIG. 3(A) and 3(B).

As shown in FIG. 1, the evaporative-cooling condensation refrigeration unit accommodates a compressor 10, an oil separator 11, constituent members including refrigerant piping and the like in the lower chamber, not shown, while the unit accommodates an evaporative condenser including a heat transfer coil 13, cooling water spray nozzles 15, a blower (in this case, a suction blower) 19, a cooling water tank 17, a circulation pump 16, cooling water piping and the like in the upper chamber, not shown, wherein the lower chamber and the upper chamber are combined in an integrated packaged construction, and the refrigeration package which has already finished with a trial run in a factory of a manufacturer is installed near a dynamic ice producing apparatus 20 as a load and thereby not only is a total length of refrigerant supply piping to the load is minimized and the number of joints in the piping in the field work decreased to its minimum level, but dangers and injuries caused by leakage of refrigerant and the like are minimized.

In the evaporative-cooling condensation type refrigeration unit, refrigerant is transformed by the compressor 10 to a high temperature compressed mass, lubricant oil for the compressor is separated in the oil separator 11 and then supplied to the evaporative condenser 18 after precooling in the precooler 12.

In the evaporative condenser 18, not only the heat transfer coil 13 receives spray of cooling water from the cooling water nozzles 15, but receives air cooling by the suction blower 19 and suction draft forces evaporation of the cooling water from the surface of the heat transfer coil 13, so that refrigerant which flows in the heat transfer coil 13 receives efficient cooling through transfer of latent heat of water evaporation and transfer of sensible heat due to reduction in temperature of environmental air.

The cooling water sprayed in an atomized form wets the surface of the heat transfer coil 13 and thereafter part of the water is discharged off in the outside air as described above. The rest of the water which falls into a lower portion without evaporation is merged with water in the cooling water tank 17 and then sprayed for the second time through the circulation pump 16.

An evaporative-cooling condensation type ammonia refrigeration unit of the present invention works in such manners that leaked ammonia gas is subjected to contact dissolution with the sprayed cooling water through the contact dissolution means to form aqueous ammonia which means is constituted using cooling water spray formed in an atomized form and a negative pressure for suction in the case of a suction blower or a forced draft pressure in the case of a forced draft blower in the above described evaporative condenser.

Evaporative-cooling condensation type ammonia refrigeration units of the present invention having the contact dissolution means are constructed in two different ways of a suction mode and a forced draft mode, which are described below.

In FIG. 2, a schematic construction in the case of the forced draft mode of a evaporative-cooling condensation type ammonia refrigeration unit of the present invention is shown.

As can be seen in the figure, the unit is constructed in a package of an integrated construction with an upper chamber 22*a* and a lower chamber 23*a*, a boundary between the upper and lower chambers thereof is provided gastight, a cooling water tank is formed with a recess which is located in a lower portion than a forced draft blower 21 provided at the unit left side, a flow guide passage 30 which communicates between the suction side of the forced draft blower 21 and the lower chamber and an outside air intake slits 31 are formed on the right side of the lower chamber.

Leaked ammonia gas produced in the lower chamber 23*a* is suctioned to the upper chamber 22*a* by the help of a negative pressure of the forced draft blower 21 as shown by a single dot/dash line through the flow guide passage 30, thereafter further rises as shown by a double-dot/dash line by a forced draft pressure, during which the leaked ammonia gas is subjected to contact dissolution with cooling water spray from the cooling water spray nozzles 15 to form aqueous ammonia, the aqueous ammonia falls into the cooling water tank 17*a* disposed in a lower portion to be stored therein and thus added aqueous ammonia is further circulated by way of the circulation pump, not shown, together with cooling water already being in the tank so as to be sprayed again.

As shown in the figure, the lower chamber 23*a* accommodates the compressor 10, the oil separator 11, the precooler 12 and refrigerant piping therein, while the upper chamber 22*a* accommodates the evaporative condenser constructed from the forced draft blower 21, the cooling water spray nozzles 15, the heat transfer 13 and the cooling water tank 17*a*.

In FIG. 3(A), a longitudinal sectional view schematically showing a construction of an embodiment in the case of a suction, evaporative-cooling condensation type ammonia refrigeration unit of the present invention is shown and in FIGS. 3(B) a side view taken in the direction of a double-point arrow III—III is shown of FIG. 3(A).

As seen in the figure, slit-like gaps 27 through which an upflow of ammonia gas can flow are provided in an upper portion boundary wall between an upper chamber 22*b* and a lower chamber 23*b*, a group of upward open trough arrays 25, each trough having a semicylindrical shape, are laterally arranged in a parallel inclined manner above the slit like gaps, while a group of downward open trough arrays 26, each trough having a semicylindrical shape, are arranged above the group of upward open trough arrays so as to cover gaps 25*a* in each of the upward trough arrays 25, so that a guides for a leaked ammonia gas is formed, a cooling water tank 17*b* is disposed on the left side of the lower chamber 23*b* and an outside air intake slit 31 is formed on the right side thereof.

With the above described construction, ammonia gas produced in the lower chamber 23*b* rises toward the slit like gaps 27 as shown by a single-dot/dash line, passes through the gaps 25*a* in the group of upward open arrays 25 after flowing through the slit like gaps 27, further passes threading its way through the leaked ammonia gas guides formed by the gaps 26*a* in the downward open trough arrays 26 and then still further rises with the help of a negative pressure of the suction blower 19. During the upward movement of the leaked ammonia gas, the leaked ammonia gas is subjected to contact dissolution to be dissolved into cooling water spray and the leaked ammonia gas after contact dissolution forms aqueous ammonia and falls downward by its gravity.

A downflow passage of thus formed aqueous ammonia and the cooling water spray to gaps in the upward open trough arrays 25 is intercepted by the downward open trough arrays 26 as shown by narrow line arrows and as a result, all the cooling water and all the aqueous ammonia are sure to flow into the upward troughs 25 and accommodated within inner spaces thereof In addition, thus accommodated aqueous ammonia and sprayed cooling water flow down in the troughs with a proper inclination to the cooling water tank 17*b* located at a lower position to be stored therein and then thus newly coming aqueous ammonia and spray cooling water are again circulated by the circulating pump, not shown, for spray through the cooling water spray nozzles 15 together with the cooling water already reserved in the cooling water 17*b*.

As shown in FIG. 3(A), the lower chamber 23*b* comprises the compressor 10, the oil separator 11, the precooler 12 and the refrigerant piping, while the upper chamber 22*b* comprises the evaporative condenser 18 constructed from the suction blower 19, the cooling water spray nozzles 15, the heat transfer coil 13 and the cooling water tank 17*b*.

The cooling water tanks 17*a* and 17*b*, an ammonia detector such as a pH meter or a conductivity meter equipped in the cooling water tank and a circulation pump constitute aqueous ammonia recovery means which can treat the leaked ammonia gas with safety in a properly manner.

In FIGS. 4(A) to 4(C) and 5(A) to 5(*c*), embodiments of contact dissolution means other than that in the suction, evaporative-cooling condensation type ammonia refrigeration unit shown in FIGS. 3(A) and 3(B) are shown.

Figure 4A:
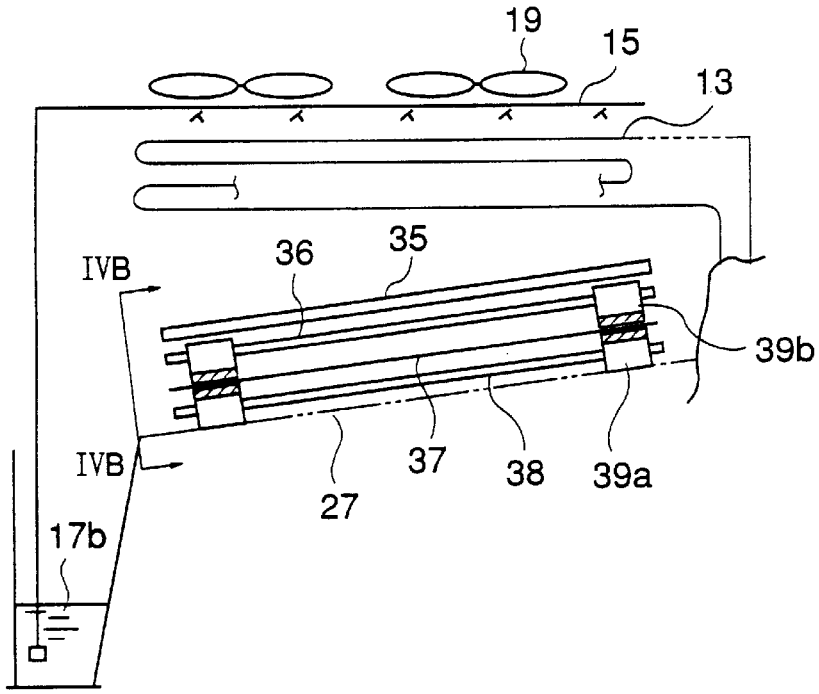
FIGS. 4(A) to 4(C) show an embodiment in the present invention of contact dissolution means of a suction, evaporative-cooling condensation ammonia refrigeration unit.
Figure 4B:
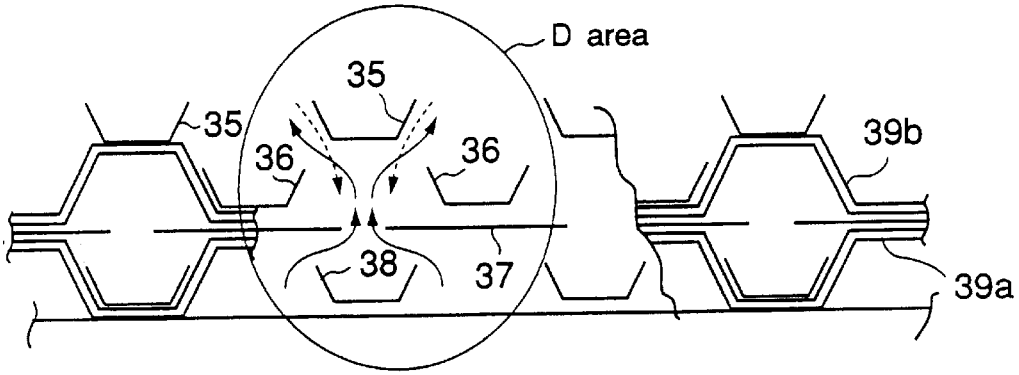
Figure 4C:
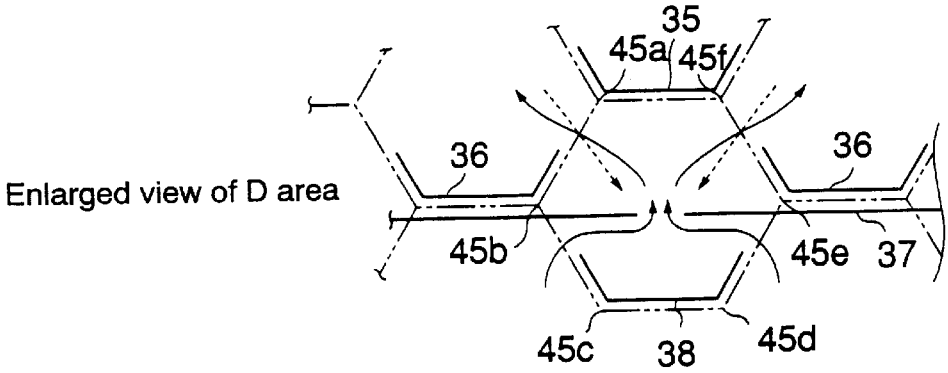

FIG. 4(A) is a longitudinal section view showing an arrangement, FIG. 4(B) is a side view taken in the direction of a double-point arrow IVB—IVB of FIG. 4(A) and a middle area thereof shows an arrangement of troughs in a zig-zag manner while eliminating connecting portions and FIG. 4(C) is an enlarged view of a D area of FIG. 4(B).

As seen in the longitudinal sectional view of FIG. 4(A) and FIG. 4(B), three hull type parallel inclined trough arrays at vertically different levels being vertically arranged in a zig-zag manner are provided along a boundary face with the slit like gaps 27 between a lower chamber and an upper chamber with two mounting members 39*a*, 39*b* interposed therebetween and thereby as seen in the enlarged view of FIG. 4(C), cellular spaces in a honeycomb structure are constructed.

In an uppermost array of troughs, troughs 35, 35, 35, . . . are provided, in the second array downward, troughs 36, 36, 36, . . . are provided being accommodated in cellular spaces each having a near hexagonal prism shape which lacks a top portion in a honeycomb structure at the respective bottoms of the cellular spaces, in the third array, troughs 38, 38, 38, . . . are provided being accommodated in cellular spaces each having a hexagonal prism shape in a honeycomb structure at the respective bottoms of the cellular spaces, and a guide plate 37 is provided under the troughs 36 to cover the upper brim of each of the lowest troughs which are adjacent to a trough 36 above the lowest trough array halfway toward its center leaving a narrow, long opening at the center of the trough in order that the sprayed cooling water is intercepted and prevented from dropping down to the boundary face in which the slit like gaps are provided.

In the contact dissolution means forming the cellular spaces in a honeycomb structure, as seen in FIG. 4(C), an upflow of the leaked ammonia gas which is shown by a solid line which is sucked by a negative pressure of the suction blower 19 through spaces between the brims of the troughs 38 in the lowest arrays and the guide plate 37 is subjected to cross/counter current contact with a downflow of the sprayed cooling water shown by a dotted line to perform sufficient gas/liquid mixing dissolution, and thus formed mixing dissolved solution flows down into the troughs 38 of an array directly arranged in a lower position thereof and recovered and stored in the cooling water tank 17*b* as shown in FIG. 4(A) flowing down in the troughs 38.

The above described gas and liquid mixing is conducted in honeycomb cellular spaces in which troughs in the second arrays are accommodated in the same manner and a mixing dissolved solution is recovered flowing down in the troughs 36, 36 . . . .

Part of the sprayed cooling water is recovered flowing down in the troughs 35, 35, 35 . . . of the uppermost arrely as it is.

Figure 5A:
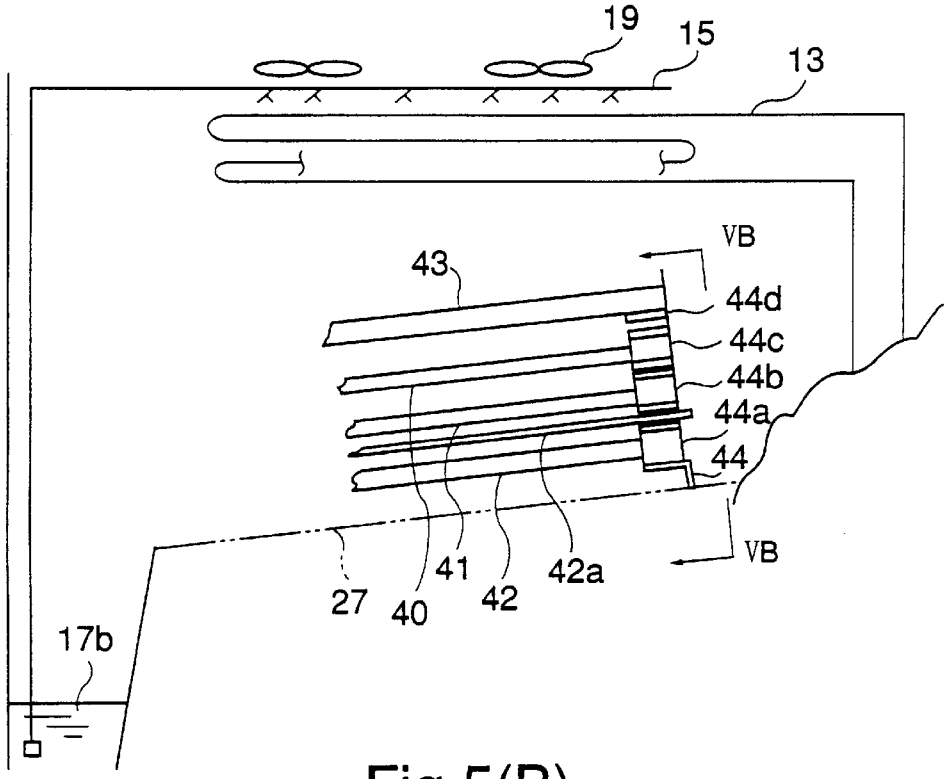
FIGS. 5(A) to 5(C) show an embodiment in the present invention of contact dissolution means of a suction, evaporative-cooling condensation ammonia refrigeration unit.
Figure 5B:
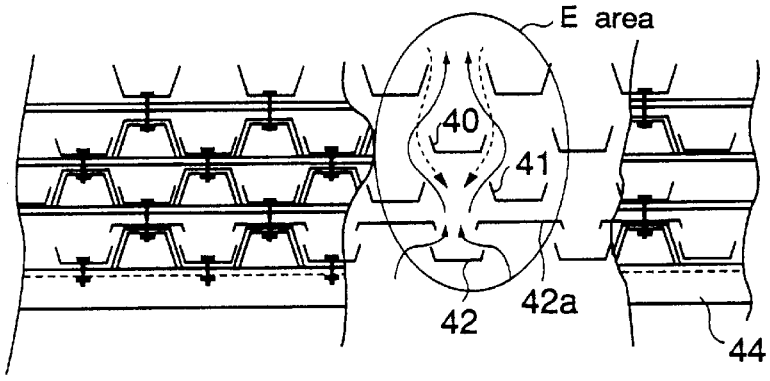
Figure 5C:
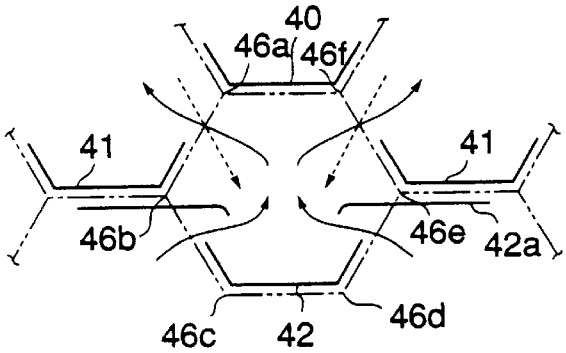
Figure 6:
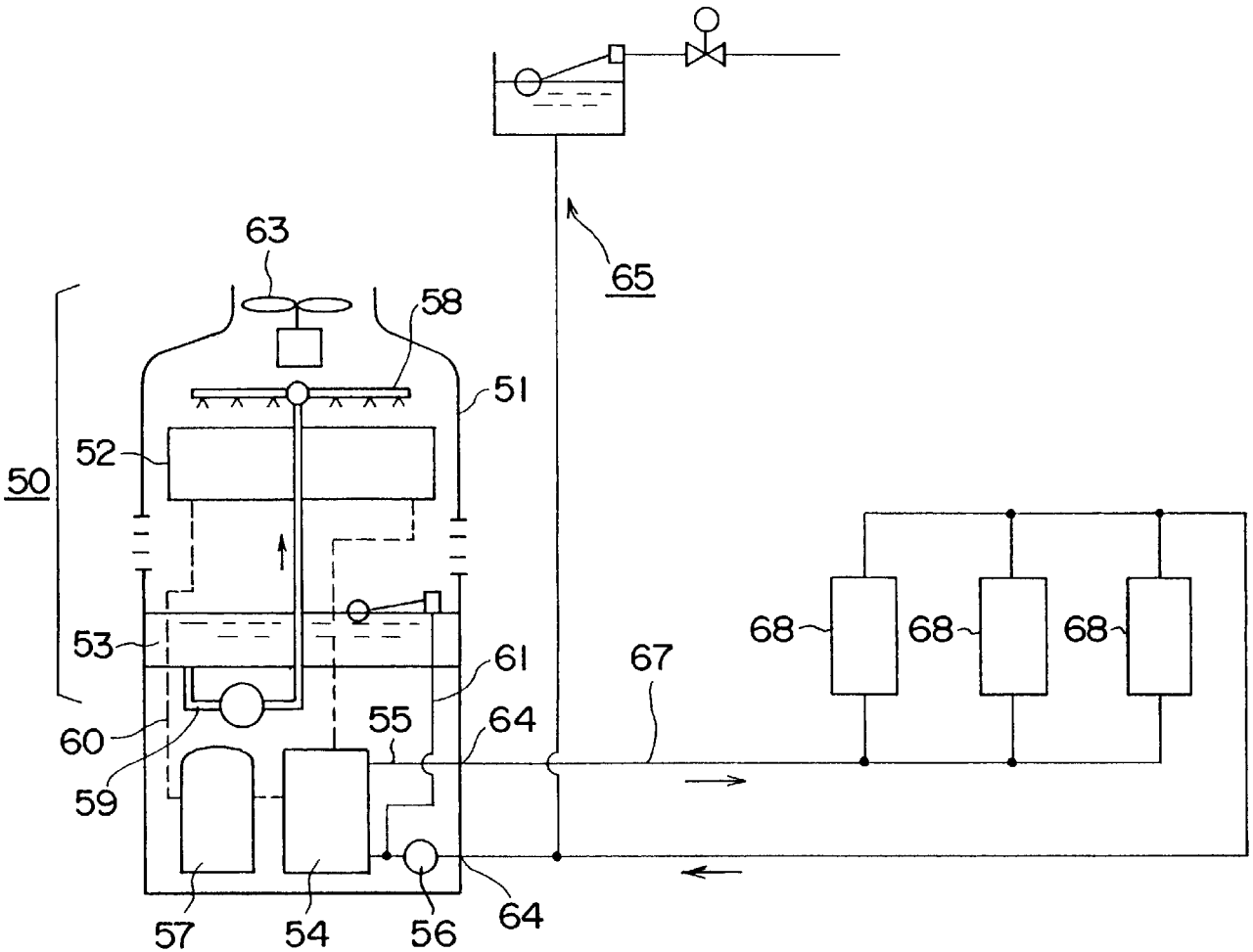
Fig. 6 PRIOR ART
FIG. 6 is a view schematically showing a conventional evaporative-cooling condensation type refrigerator.

FIGS. 5(A) to 5(C) are views showing the second embodiment different from the embodiment of FIGS. 3(A) and 3(B), FIG. 5(A) is a longitudinal sectional view showing an arrangement of the upper half, wherein the lower half is cut away, FIG. 5(B) is a side view taken in the direction of a double-point arrow VB—VB of FIG. 5(A) and a middle area thereof shows an arrangement of troughs in a zig-zag manner while eliminating connecting portions and FIG. 5(C) is an enlarged view of an E area of FIG. 5(B).

As seen in the longitudinal sectional view of FIG. 5(A) and FIG. 5(B), four hull type parallel inclined trough arrays of vertically different levels being vertically arranged in a zig-zag manner are provided along the boundary face with slit like gaps 27 between a lower chamber and an upper chamber with a shaped steel 44 which is a metal bracket and mounting members 44*a*, 44*b*, 44*c*, 44*d* interposed between the lowest trough array and the boundary, or between the trough arrays and thereby as seen in the enlarged view of FIG. 5(C), cellular spaces in a honeycomb structure are constructed.

In a uppermost array of troughs, troughs 43, 43, 43, . . . are provided, in the second array downward, troughs 40, 40, 40, . . . are provided being accommodated in cellular spaces in a honeycomb each having a near hexagonal prism shape which lacks top portion in a honeycomb structure at the respective bottoms, in each of the third array troughs 41, 41, 41 and the lowest array troughs 42, 42, 42, . . . are provided being accommodated in cellular spaces in a honeycomb each having a hexagonal prism shape in a honeycomb structure at the respective bottoms, and a guide plate 42*a* is provided under the troughs 41 to cover the upper brim of each of the lowest troughs which are adjacent to a trough 36 above the lowest trough array halfway toward its center leaving a narrow, long opening at the center of trough in order that the sprayed cooling water is intercepted and prevented from dropping down to the boundary face in which the slit like gaps 27 are provided.

In the contact dissolution means forming the cellular spaces in a honeycomb structure, as seen in FIG. 5(C), an upflow of the leaked ammonia gas which is shown by a solid line which is sucked by a negative pressure of the suction blower 19 through spaces between the brims of the troughs 42 in the lowest arrays and the guide plate 42*a* is subjected to cross/counter current contact with a downflow of the sprayed cooling water shown by a dotted line to perform sufficient gas/liquid mixing dissolution, and thus formed mixing dissolved solution flows down into the troughs 42 of an array directly arranged in a lower position thereof and recovered and stored in the cooling water tank 17*b* as shown in FIG. 5(A) flowing down in the troughs 42.

The above described gas and liquid mixing is conducted in honeycomb cellular spaces in which troughs in the second arrays are accommodated in the same manner and a mixing dissolved solution is recovered flowing down in the troughs 40, 41 . . . .

Part of the sprayed cooling water is recovered flowing down in the troughs 43, 43, 43 . . . in the uppermost array as it is.

In addition, the guide plate 42*a* are bent downward at both ends and thereby the sprayed cooling water is easy to flow down toward the both ends, while a depth of the troughs in a higher array is deeper than in a lower array.

The arrangements in a zig-zag manner shown in FIGS. 4(A) to 4(C) and 5(A) to 5(C) can be of a plurality of levels exceeding the three or four levels shown the figures. Besides, the guide plate and the troughs and the like are preferably fabricated using a galvanized iron sheet which is anticorrosive.

EFFECT OF THE INVENTION

With the above constructions of the present invention in use, a refrigeration unit with safety and efficiency being locating from another unit in a spaced manner can be provided in order to cope with leakage of ammonia gas which is most concerned when ammonia is employed as refrigerant. The arrangement of parallel troughs at multiple levels in a vertically zig-zag manner is adopted, cross, countercurrent gas/liquid mixing is achieved in honeycomb cellular spaces and thereby absorption of leaked ammonia gas by cooling water spray can be realized with good efficiency.

What is claimed is:

1. An evaporative-cooling condensation type ammonia refrigeration unit with a fully packaged construction locating from another unit in a spaced manner which is provided with an upper chamber for accommodating an evaporative condenser to condense ammonia gas and a lower chamber for accommodating a compressor to compress ammonia gas and a ammonia piping system, comprising: contact dissolution means in which leaked ammonia gas from the ammonia piping system is guided into the upper chamber from the lower chamber and can be dissolved through contact into cooling water spray of the evaporative condenser; and aqueous ammonia recovery means.

2. An evaporative-cooling condensation type ammonia refrigeration unit according to claim 1, wherein the contact dissolution means comprises: a gas guide constructed from upward-open troughs each having a semicylindrical shape for recovering sprayed cooling water; and downward-open troughs each having a semicylindrical shape for not only guiding the sprayed cooling water into the upward open troughs by intercepting a downflow of the sprayed cooling water into the gaps between the recovery troughs but forming detour passages for the upflow of the leaked ammonia gas, while gaps for permitting an upflow of leaked ammonia gas therethrough are provided in the space under the evaporative condenser in the upper chamber; and a negative pressure produced by a suction blower for the evaporative condenser.

3. An evaporative-cooling condensation type ammonia refrigeration unit according to claim 1, wherein the contact dissolution means is provided with a group of three or more lateral arrays of parallel inclined troughs for cooling water spray recovery of vertically different levels being vertically arranged in a zig-zag manner while gaps for permitting an upflow of leaked ammonia gas therethrough are provided in the boundary between the upper and lower chambers, wherein the troughs in each of the second level and the following levels downward are respectively inserted in cellular spaces of a honeycomb structure each having a hexagonal prism or a near hexagonal prism shape, and comprises: countercurrent gas/liquid mixing sections each formed between an upflow of leaked ammonia gas formed along both sides of a trough inserted in a cellular space and a downflow of sprayed cooling water from an upper portion; a gas guide for permitting a gas flow provided in order to guide an upflow of the leaked ammonia gas, while preventing a downflow of the sprayed cooling water into a gap between adjacent troughs in the lowest level array from occurring; and a negative pressure of a suction blower which produces the upflow of the leaked ammonia gas.

4. An evaporative-cooling condensation type ammonia refrigeration unit according to claim 1, wherein the contact dissolution means comprises: a flow guide passage for leaked ammonia gas provided on the suction side of the forced draft blower in the upper chamber which is communicated from the perfectly gastight lower chamber and a negative pressure on the suction side, whereby the leaked ammonia gas can be dissolved through contact into cooled water spray.

5. An evaporative-cooling condensation type ammonia refrigeration unit according to claim 1, wherein the aqueous ammonia recovery means comprises: a recovery and circulation cooling water tank, which is communicated to a lower portion of the upper chamber, and which is disposed on the side of the lower chamber; an ammonia detector; and a cooling water circulation pump.

* * * * *